US007254924B2

(12) United States Patent
Regina

(10) Patent No.: US 7,254,924 B2
(45) Date of Patent: Aug. 14, 2007

(54) SOLAR REFLECTIVE VENTILATED TRANSLUCENT BLOCKS

(76) Inventor: Samuel R. Regina, 3800 S. Cantabria, #1037, Chandler, AZ (US) 85248

( * ) Notice: Subject to any disclaimer, the term of this patent is extended or adjusted under 35 U.S.C. 154(b) by 320 days.

(21) Appl. No.: 10/684,921

(22) Filed: Oct. 14, 2003

(65) Prior Publication Data

US 2004/0123540 A1 Jul. 1, 2004

Related U.S. Application Data

(63) Continuation-in-part of application No. 10/142,306, filed on May 8, 2002.

(51) Int. Cl.
*E04C 1/42* (2006.01)

(52) U.S. Cl. ..... 52/306; 52/171.3

(58) Field of Classification Search ..... 52/306, 52/309.3, 309.5, 171.3, 590.2, 591.1, 592.1, 52/592.6, 775, 604, 307; 40/405
See application file for complete search history.

(56) References Cited

U.S. PATENT DOCUMENTS

| | | | | |
|---|---|---|---|---|
| 4,628,652 A | | 12/1986 | Wefels | |
| 4,807,412 A | | 2/1989 | Frederiksen | |
| 4,891,925 A | | 1/1990 | Carlson et al. | |
| 5,014,479 A | | 5/1991 | Yeh et al. | |
| 5,033,245 A | * | 7/1991 | Kline | 52/306 |
| 5,038,542 A | * | 8/1991 | Kline | 52/306 |
| 5,121,575 A | | 6/1992 | DeGarmo et al. | |
| 5,247,773 A | | 9/1993 | Weir | |
| 5,259,161 A | | 11/1993 | Carter | |
| 5,367,846 A | | 11/1994 | vonRoenn, Jr. | |
| 5,588,271 A | * | 12/1996 | Pitchford | 52/306 |
| 5,595,033 A | | 1/1997 | Frey | |
| 5,778,620 A | | 7/1998 | Fisher | |
| 5,836,125 A | * | 11/1998 | Regina | 52/306 |
| 5,904,019 A | * | 5/1999 | Kooij et al. | 52/306 |
| 5,910,086 A | | 6/1999 | Fisher | |
| 5,970,673 A | | 10/1999 | Fisher | |
| 5,987,829 A | | 11/1999 | Fisher | |
| 6,260,317 B1 | * | 7/2001 | Fisher | 52/306 |
| 6,393,786 B1 | * | 5/2002 | Hudson et al. | 52/306 |

* cited by examiner

*Primary Examiner*—Naoko Slack
*Assistant Examiner*—Yvonne M. Horton
(74) *Attorney, Agent, or Firm*—Cahill, von Hellens & Glazer P.L.C.

(57) ABSTRACT

A vented hollow translucent/transparent plastic block for use in wall construction includes a sheet of solar radiation reflective material disposed therein to define two compartments within the plastic block. A vent is disposed in a side wall of the plastic block in fluid communication with each of the compartments to alleviate any pressure increase/decrease within the plastic block and for discharging any condensation within the plastic block that may occur.

20 Claims, 4 Drawing Sheets

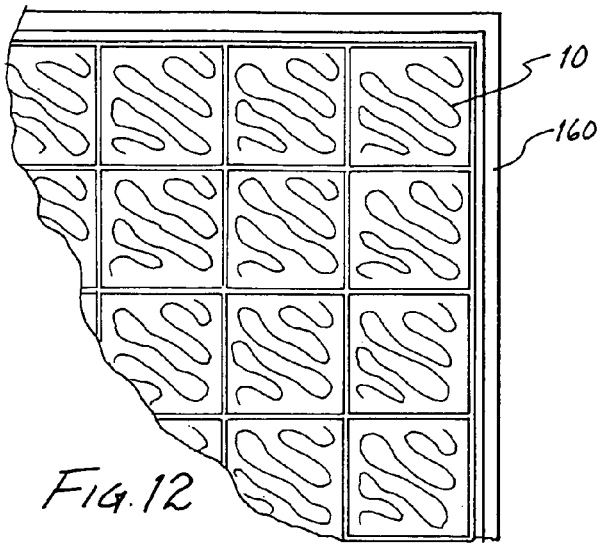
FIG. 12
FIG. 8
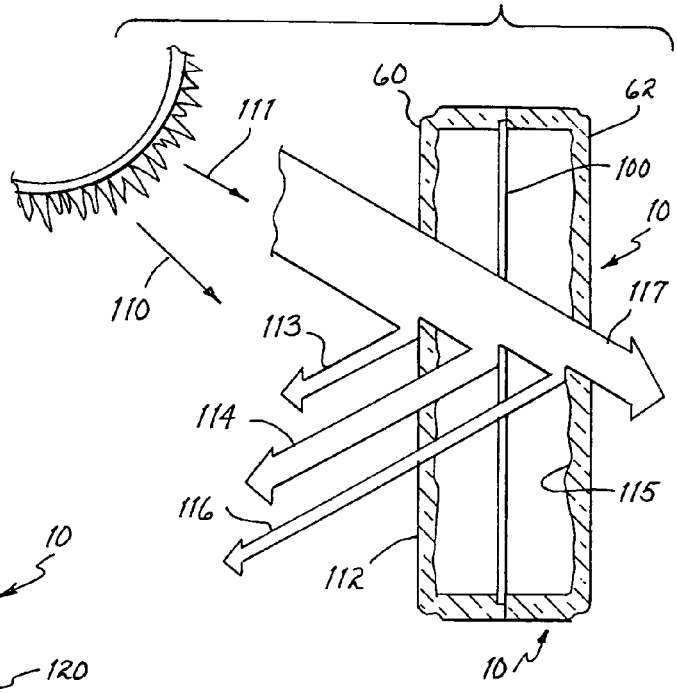
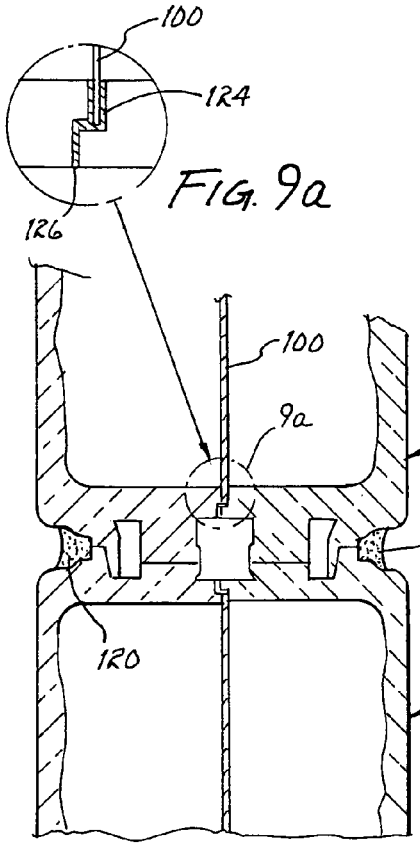
FIG. 9a
FIG. 9

SOLAR REFLECTIVE VENTILATED TRANSLUCENT BLOCKS

CROSS REFERENCE TO RELATED APPLICATIONS

The present application is a continuation-in-part application of an application entitled "Ventilated Interlocking Translucent Blocks", filed May 8, 2002, and assigned Ser. No. 10/142,306 describing an invention by the present inventor.

BACKGROUND OF THE INVENTION

1. Field of the Invention

The present invention relates to transparent/translucent blocks as building materials used in commercial and residential construction and, more particularly, to ventilated interlocking blocks of manmade materials and having a solar reflective panel peripherally supported therein.

2. Description of Related Art

For decades, hollow glass blocks have been used to form interior or exterior walls or sections thereof in order to permit transmission of light through such walls. Usually, these glass blocks distort any images viewed therethrough or the blocks may be translucent to permit passage of light and yet provide a significant degree of privacy. For example, glass blocks have been used as part of a bathroom wall to permit transmission of light therethrough, particularly important if there are no windows in the bathroom, and yet provide privacy. In a commercial or private environment, walls or wall dividers have been formed of translucent hollow glass blocks to delineate floor space while accommodating light transmission therethrough to create a more airy and open environment without compromising privacy.

Hollow glass blocks serve the sought end result very well but several difficulties are created. First, the glass blocks are relatively heavy and generally are only permitted to be used under building codes in conjunction with supporting brick walls; conventional wood frame construction is generally considered of insufficient structural strength to support a panel of glass blocks. Second, transport of the glass blocks from a point of manufacturer to the end user is generally expensive because of the weight and the attendant crating and shipping costs. Third, in order to accommodate the change in pressure within the hollow part of the glass block due to temperature and elevational changes, the glass walls must be very thick. Fourth, assembling a wall, wall section or panel of glass blocks requires a skilled artesian to properly align the glass blocks and to exercise skill in securing the glass blocks to one another with a binding agent. Fifth, exterior walls of glass block permit solar transmission therethrough causing heating of the environment interior of the glass block panel.

To overcome the weight and handling difficulties attendant hollow glass blocks, hollow blocks of transparent/translucent manmade materials have been developed; hereinafter referred to as plastic blocks. These plastic blocks generally include interlocking elements to permit seating and rapid assembly. In some circumstances, depending upon the configuration and use of the plastic block, a binding and/or sealing agent must be used. The primary benefits of plastic blocks include light weight, ease of handling and installation, and relatively low cost.

The plastic blocks are hollow and the interior space is sealed against intrusion of foreign matter as well as air. In response to temperature changes or changes in elevation (primarily during shipping), the pressure within the plastic blocks increases and decreases proportionately. The pressure changes within the plastic blocks generally result in inward or outward flexing of the walls of the plastic block. Such flexing creates stresses within the plastic material. During cleaning with conventional cleaning agents, lines of stress become visually apparent. The resulting disfiguration becomes permanent and compromises the aesthetics of the wall, wall section or panel formed of the plastic blocks.

As with glass blocks, transparent or translucent plastic blocks permit penetration of solar radiation. The solar radiation transmitted into the plastic block impinges upon the interior side wall and causes heating of the interior side wall. Heat from the side wall will radiate into the adjacent environment and raise its temperature. Furthermore, solar radiation transmitted through the plastic block will heat any solar radiation impinged objects and the temperature of the ambient environment will be raised. If the solar radiation is particularly intense, it can also cause damage to or deterioration of objects by heating them or if they are sensitive the frequency spectrum of the solar radiation.

SUMMARY OF THE INVENTION

The present invention is directed to ventilated transparent and/or translucent hollow plastic blocks having interlocking elements for rapidly building a wall, a wall section or a panel of such plastic blocks. Ventilation of the plastic blocks to avoid imposing stresses on the walls of the plastic blocks due to temperature changes and elevational changes is provided. A sheet of material for reducing transmission of solar radiation through the plastic block extends across the interior of the plastic block. Equalization of pressure within each plastic block with the ambient pressure is provided by a single vent disposed in the bottom side wall of a mounted plastic block. The vent is also in fluid communication with the interior space or compartment on either side of the sheet of material.

It is therefore a primary object of the present invention to provide a ventilated plastic block that reduces transmission of solar radiation therethrough.

Another object of the present invention is to provide a ventilated translucent or transparent plastic block for use as a wall section or panel that reduces heating of the plastic block adjacent the interior surface of the wall section or panel.

Yet another object of the present invention is to provide a sun screen interior of a ventilated plastic block.

Still another object of the present invention is to provide is to provide a single vent for ventilating the space on either side of a sun screen extending across the interior of a plastic block used in the construction of a wall or of a panel.

A further object of the present invention is to provide a specifically located single aperture serving as a vent in a transparent or translucent hollow plastic block to reduce the likelihood of condensation settling on the interior surfaces of the hollow plastic block or on a sun screen disposed therein.

A yet further object of the present invention is to provide a two part ventilated transparent or translucent plastic block having a sun screen mounted therebetween.

A still further object of the present invention is to provide a method for assembling a sun screen within a hollow transparent or translucent plastic block.

A still further object of the present invention is to provide a method for avoiding stressing the side walls of a hollow plastic block and a sun screen disposed therein due to pressure changes resulting from temperature and elevational changes.

A still further object of the present invention is to provide a method for reducing transmission of solar energy through a hollow transparent or translucent plastic block.

These and other objects of the present invention will become apparent to those skilled in the art as the description there proceeds.

BRIEF DESCRIPTION OF THE DRAWINGS

The present invention will be described with greater specificity and clarity with reference to the following drawings, in which:

FIG. 8 illustrates the reflection of solar radiation of a transparent or translucent plastic block having an interiorly located sun screen;

FIG. 9 illustrates a partial cross section of two interlocked plastic blocks, each plastic block supporting a sun screen retained without an adhesive at the junction of the members of the plastic blocks;

FIG. 9A is a detail view taken within dashed circle 9A and illustrates the use of an adhesive to retain the sun screen;

FIG. 12 illustrates a plurality of transparent or translucent plastic blocks mounted within a circumscribing frame.

DESCRIPTION OF THE PREFERRED EMBODIMENT

Interlocking unventilated plastic locks have been developed by the applicant, as illustrated and described in U.S. Pat. No. 5,836,125. The illustrations and writings contained therein are incorporated herein by reference. Accordingly, many of the features common with the present invention, particularly with respect to the interlocking and alignment elements, will be only summarily discussed as the details thereof are set forth in U.S. Pat. No. 5,836,125.

Figure 1:
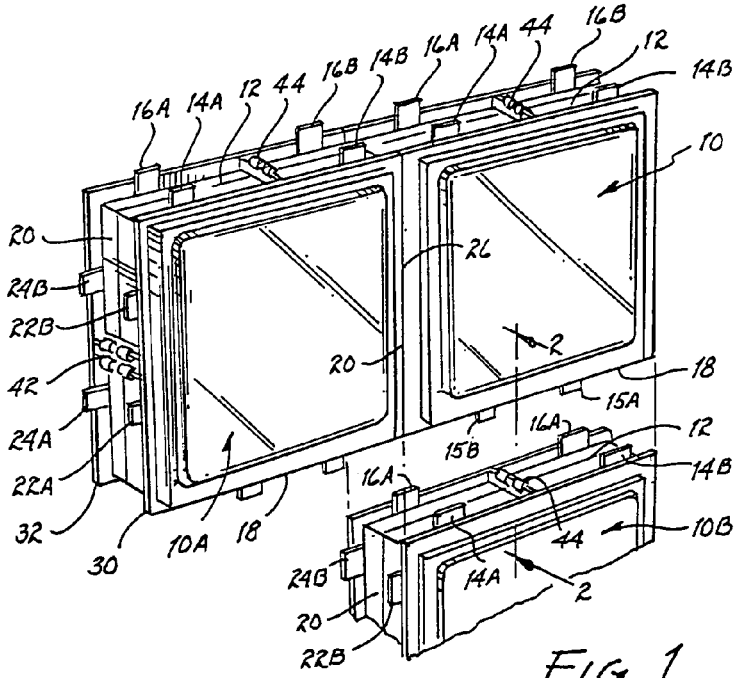
FIG. 1 illustrates a plurality of interlocked plastic blocks.

Referring to FIG. 1 there is shown a plurality of interlocking plastic blocks 10, 10A and 10B which are preferably, but not necessarily, of acrylic material. Edge 12 of each plastic block includes two pairs of alignment tabs 14A, 14B and 16A, 16B. The tabs of each pair of these pairs of tabs are relatively widely spaced from one another, as illustrated. Opposite edge 18 of plastic block 10 includes two pairs of alignment tabs of which tabs 15A,15B are shown; these pairs of tabs are spaced closer to one another than pairs of tabs 14A,14B and 16A,16B. Edge 20 of each plastic block also includes two pairs of alignment tabs 22A,22B and 24A,24B. The space between the alignment tabs of these two pairs of tabs is less than the space between pairs of alignment tabs 14A,14B and 16A,16B and corresponds with the spacing of pairs of tabs 15A,15B. Edge 26 of each plastic block includes two pairs of alignment tabs equivalent in spacing and location to pairs of alignment tabs 14A,14B and 16A,16B. Each of these alignment tabs bears against the inside surface of a corresponding one of circumferential flanges 30, 32 of an adjacent interlocking plastic block. Moreover, flanges 30, 32 serve as the bearing surfaces between adjacent blocks. Thereby, plastic blocks 10, 10A and 10B are easily assembled with one another in perfect alignment to form a wall section, window, divider, etc.

Generally, an assembly of plastic blocks is bounded by structure such as a strap or the like to ensure stability of the assembled structure wherein the structure is to be used. Additionally, a frame of wood, metal or other material may be used as a boundary within which the plastic blocks are mounted. A mastic or other binding agent may be used to secure the blocks to one another.

Figure 2:
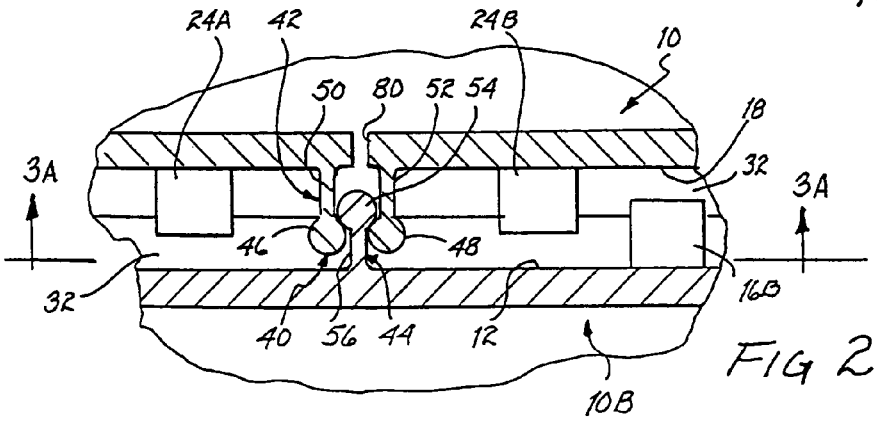
FIG. 2 is a cross sectional view taken along lines 2—2, as shown in FIG. 1.

As particularly shown in FIG. 2, a snap fit mechanism may be incorporated to retain the blocks in place with one another during assembly. As the details of the snap fit mechanism are further described in U.S. Pat. No. 5,836,125 the following discussion will be relatively brief. Snap fit mechanism 40 may include a female receptacle 42 to be engaged by a male coupling 44. The female receptacle includes a pair of cylindrical locking members 46,48 located at the extremity of respective wall members 50,52. Male coupling 44 includes a cylindrical member 54 supported upon a wall member 56. As shown in FIG. 2, the spacing between cylindrical members 46,48 of female receptacle 44 is less than the diameter of cylindrical member 54 of male coupling 44. To permit penetration therebetween, wall members 50,52 of the female receptacle are resilient and sufficiently flexible to permit insertion and removal of the male coupling. As shown in FIG. 1, and other figures, each side of each plastic block may include a pair of snap fit mechanisms 40. As further noted in FIG. 1, edge 12 supports a male coupling 44 and opposite edge 18 supports a female receptacle 42. Edge 20 supports a female receptacle 42 and opposite edge 26 supports a male coupling 44. Thereby, the plastic blocks will be oriented to locate bottom edge 18 of one plastic block adjacent the top edge of another plastic block. When such placement occurs, the alignment tabs will be properly mated and the corresponding snap fit mechanisms will be functional.

Figure 4:
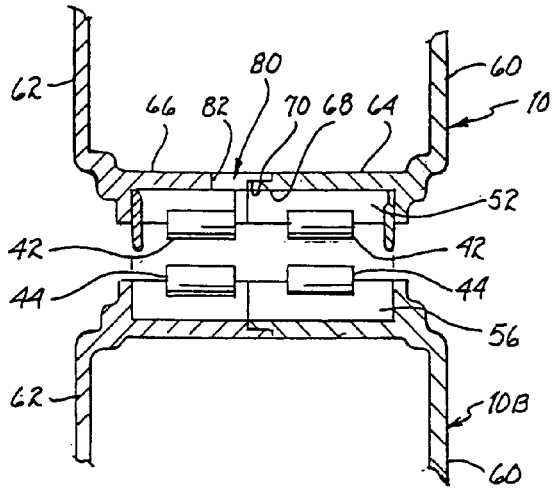
FIG. 4 is a cross sectional view taken along lines 4—4, as shown in FIG. 3A.
Figure 5A:
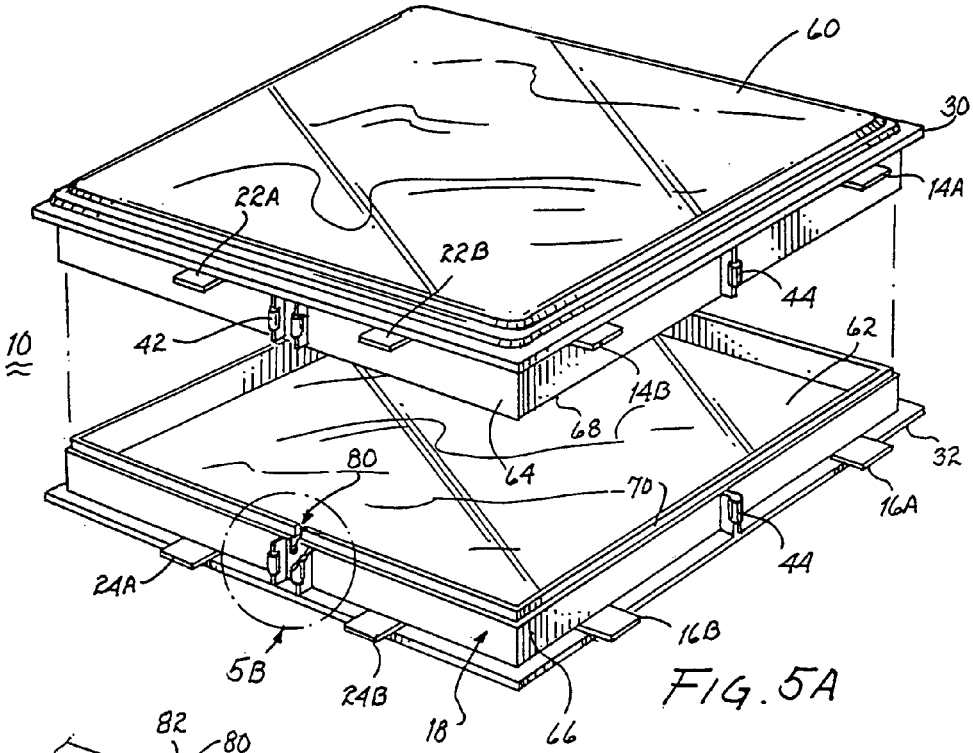
FIG. 5A illustrates the two halves or members of a plastic block prior to assembly.

As particularly shown in FIGS. 4 and 5A, each of the plastic blocks (10, 10A, 10B) is formed of two members 60,62. Member 60 includes a four-sided side wall 64 and member 62 includes a similar four-sided side wall 66. For structural reasons and to obtain a good bond between the members, side wall 64 includes a peripheral lip 68 that mates with a peripheral undercut 70 in side wall 66. Upon mating and bonding members 60,62 with one another, an enclosed space is formed within the two members.

During transport of the plastic blocks, changes of elevation occur. Such changes of elevation would create a pressure differential between the space interior of each plastic block and ambient pressure. Unless each plastic block were vented, such pressure differential would cause the sides of the plastic block to flex in response to the degree of pressure differential. Similarly, during changes of the ambient temperature as a result of a plastic block being subjected to solar radiation, other source of heating or a cooling environment, the temperature within a sealed plastic block would change with a commensurate increase or decrease in pressure of the contained air and the sides of the plastic block would flex in conformance therewith.

One of the reasons for having prior art glass blocks and prior art plastic blocks sealed is to prevent condensation to develop on the inside surfaces due to a change in temperature or ambient pressure by preventing air flow through such a block. However, it has been learned that the plastic blocks of the type illustrated and described herein can be vented without a resulting condensation and thereby obviate a pressure differential between the interior of the plastic block and the ambient pressure and prevent flexing of the sides of the plastic block. However, it has been learned that such venting must be configured in a specific manner to prevent cross flow within the plastic block and to minimize an air exchange with attendant introduction of moisture laden air. Furthermore, it has been learned that if the vent is on the bottom edge, any condensation that may develop, although unlikely, it can and will drain through the vent.

Figure 3A:
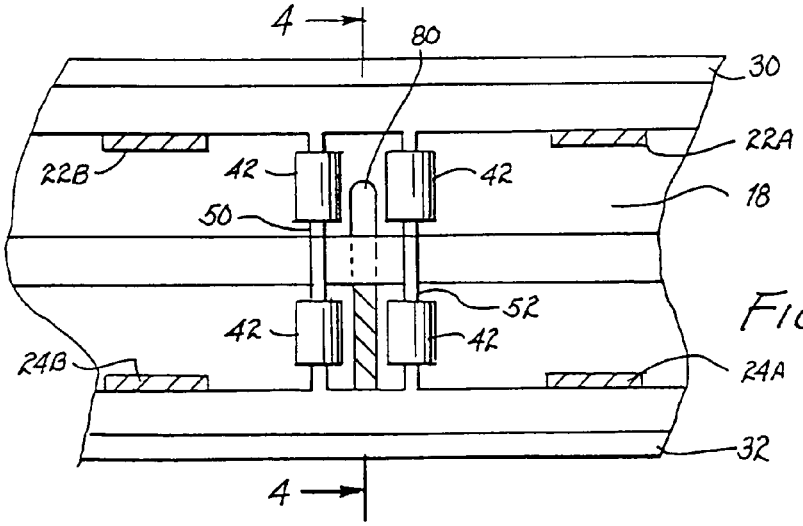
FIG. 3A is a cross sectional view taken along lines 3A—3A, as shown in FIG. 2.
Figure 5B:
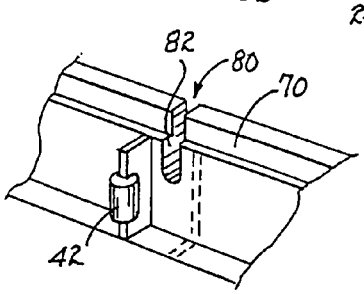
FIG. 5B is a detailed view of the section encircled and identified with reference numeral 5B shown in FIG. 5A.

Referring particularly to FIGS. 4, 5A and 5B, the vent developed for use with plastic block 10 will be described. Vent 80, located in bottom edge 18 of plastic block 10 is formed by a slot 82 extending into side wall 66 past undercut 70. Upon mating of side walls 64,66 lip 68 covers a part of slot 82 to the extent of the width of undercut 70. The resulting vent is particularly shown in FIGS. 2 and 3A.

Vent 80 accommodates a flow of air into and out of plastic block 10 only as a function of changes in pressure outside or inside the plastic block. The vent is sized small enough to preclude any cross flow of air within the plastic block. That is, air can not enter at one location and depart at a different location. With such lack of cross flow within the plastic block, it has been learned that condensation within the plastic block will almost never occur. Yet, the use of a single vent of relatively small size will preclude flexing of the sides of the plastic block causing the stresses that ultimately will become visible upon cleaning the plastic block with conventional cleaning agents.

Figure 3B:
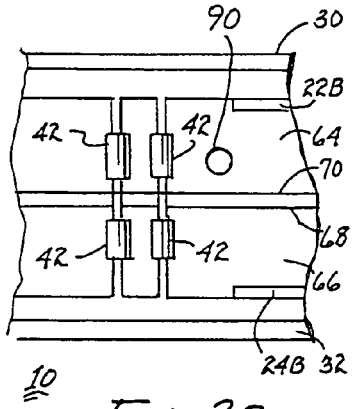
FIG. 3B illustrates a variant of the ventilation aperture shown in FIG. 3A.

FIG. 3B illustrates a variant vent 90 of vent 80. A simple hole in one side wall of block 10 may be formed therein during fabrication of the respective member 60/62 provided that such aperture side wall be at the bottom when the plastic block is mounted in place. Under certain circumstances, variant vent 90 may be formed post manufacturing by drilling a hole, as illustrated.

By experimentation, it has been learned that the size of vent 80 or variant vent 90 should have an area equivalent to a round hole having a diameter in the range of about 0.005 inches to about 0.25 inches. Optimally, the size of vent 80 or variant vent 90 should have an area equivalent to a circle having a diameter in the range of about 0.012 inches to about 0.015 inches to minimize the likelihood of inflow of moisture and yet permit an outflow of moisture if such inflow does occur. Thereby, an environment of trapped moisture will be eliminated. These area dimensions were developed as a result of significant testing during transport of the plastic blocks over roads having varying elevations and by subjecting them to temperature differentials over a period of time.

Figure 6:
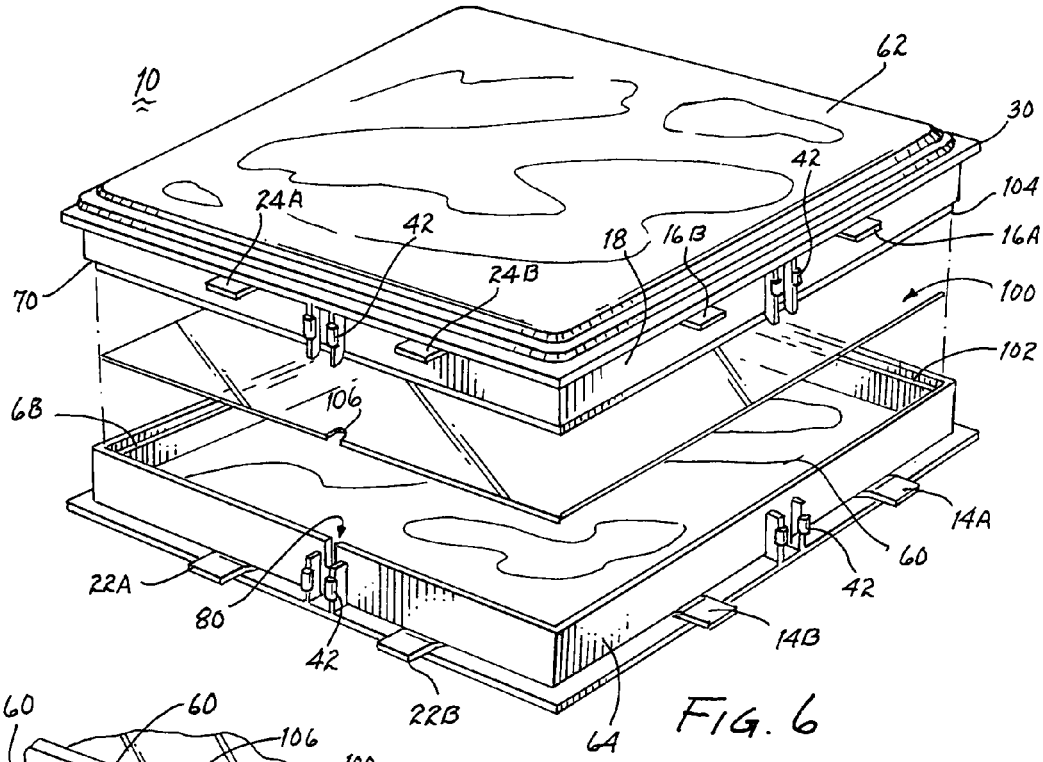
FIG. 6 illustrates the two halves or members of a plastic block prior to assembly and having an interleaved sheet of sun screen.

Referring to FIG. 6, a pair of members 60, 62 as described in detail above, are illustrated; as may be noted, these members are reversed with respect to the same members shown in FIG. 5A. That is, undercut 70 is in upper member 62 and lip 68 is in lower member 60. The two sides of these members not shown in this Figure support male couplings 44, as shown in FIG. 5A. A sheet 100 of colored plastic material (film) is interleaved between members 60, 62. This material serves in the manner of a sun screen to reflect, absorb and transmit differing quantities of solar radiation as a function of the material itself and the coloring thereof. An acceptable type of film for this purpose is identified as product number N1020 SR CDF sold by CP Films of Martinsville, Va., Preferably, sheet 100 is dimensioned rests upon shelf 102 interior of lip 68. Upon mating of members 60 and 62, flange 104 attendant undercut 70 will nest within lip 68 and bear against sheet 100 supported by shelf 102. Thereby, sheet 100 is mechanically retained intermediate member 60, 62 at the intersection thereof.

Upon mounting of sheet 100 within plastic block 10, the sheet will define one compartment within member 60 and a further compartment within member 62. As discussed above, changes in temperature within or without plastic block 10 will result in a change of pressure within the plastic block. Any such change of pressure within the formed compartment formed in either of members 60, 62 may result in bowing of sheet 100. To prevent such bowing due to unequal pressures in the two compartments, a small slot 106 is formed in an edge of the sheet. This slot permits fluid communication between the two compartments to equalize the pressures therein. An aperture in the sheet could also be used.

Figure 7:
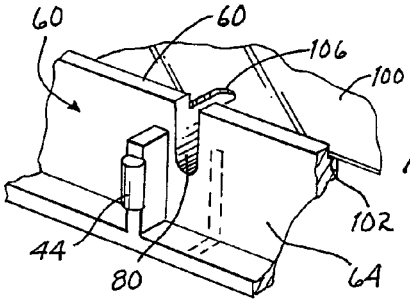
FIG. 7 is a partial view illustrating the vent in the plastic block in fluid communication with the space or compartment on either side of the sun screen.

As particularly shown in the detail view illustrated in FIG. 7, slot 106 is coincident with vent 80. Thereby, each of the compartments formed within members 60, 62 is vented through vent 80. As described above, any condensation that may be formed within either or both of the compartments will drain through vent 80; it is noted above, the side of plastic block 10 containing vent 80 is always mounted facing downwardly.

As representatively illustrated in FIG. 8, solar radiation, depicted by arrows 110, 111, impinges upon surface 112 of member 60. A certain amount of the solar radiation is reflected from surface 112, as depicted by arrow 113. A further quantity of solar radiation impinged upon sheet 100 is reflected, as depicted by arrow 114. The quantity of solar radiation reflected from the sheet is a function of the reflective characteristics of the sheet and may be varied by selecting the sheet from material having certain desired solar radiation reflective properties. When the solar radiation impinges upon interior surface 115 of member 62, a further quantity of solar radiation will be reflected, as depicted by arrow 116. The remaining solar radiation, depicted by arrow 117, will enter the environment on the other side of plastic block 10. One may therefore come to the inescapable conclusion that the amount of solar radiation reflected by a plastic block 10 having sheet 100 mounted therewithin is a function of the choice of material for the sheet. As material can be selected with different transmissive characteristics to different frequencies of solar radiation, control of tranmissivity through plastic block 10 is readily achieved by the simple solution of selecting sheet 100 of a material corresponding with the desired results. It is also to be noted that the sides of members 60, 62 through which solar radiation is transmitted have a property for absorbing a certain amount of radiation. Similarly, the material of sheet 100 has a property for absorption of solar radiation.

Referring to FIG. 9, there are illustrated two plastic blocks 10 mounted one above the other. The mounting and interconnections therebetween are described in detail above. To ensure sealing of the junction between adjacent blocks, a rubberized silicon grout 120, or the like, may be troweled in the peripheral cavity formed at the junction of the blocks.

As discussed above, sheet 100 may be retained in place simply by mating members 60, 62 with one another. In the event manufacturing tolerances of the plastic blocks may cause either unacceptable compression/bowing of the sheet or a to loose a fit, a mastic or adhesive 124 may be used, as depicted in FIG. 9A. An adhesive suitable for this purpose is identified as WELD-ON 3 sold by IPS Corporation of Compton, Calif. Use of such adhesive would permit wider tolerances for the manufacture of the edges of members 60, 62 and yet not compromise the fit and retention of sheet 100. Furthermore, adhesive 126 used to join the blocks with one another may be used to also secure sheet 100 therebetween. Other methods of attachment, such as melting by application of heat, welding by any of various processes or chemical welding may be employed.

Figure 10:
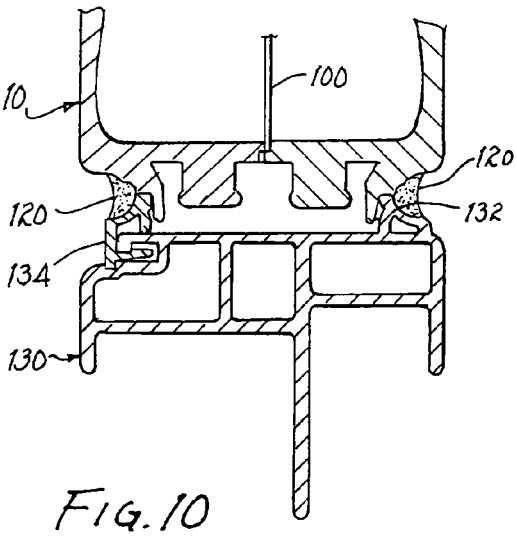
FIG. 10 illustrates a plastic block set within a vinyl frame.

FIG. 10 illustrates a commercially available frame 130 used to define an opening to be filled with a plurality of plastic blocks 10. This frame includes a shoulder 132 bearing against plastic block 10 and permits installation of a plurality of plastic blocks within the perimeter of the frame. A clip or glazing stop 134 interconnects with frame 130 and bears against the other side of plastic block 10 to serve in the manner of a stop or dam to prevent displacement of the plastic block from within the frame. To obtain a seal between plastic blocks 10 and frame 130, grout 120 may be used.

Figure 11:
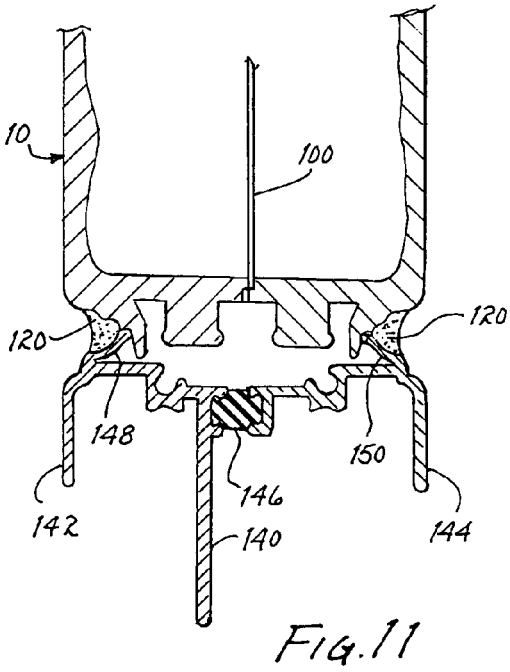
FIG. 11 illustrates a plastic block set within an aluminum frame.

FIG. 11 shows an alternative commercially available frame 140 of aluminum to define the perimeter of a space within which plastic blocks 10 are to be mounted. To prevent heat transmission through frame 140, exterior and interior elements 142, 144 are mechanically joined and thermally insulated from one another by an element 146 having the requisite properties. Flanges 148, 150 extend inwardly from frame 140 for mating engagement with the corresponding edges of plastic block 10. Grout 120 may be used to seal the junction between each of the plastic block and the frame.

As shown in FIG. 12, a frame 160 is formed in the requisite size to accommodate the location of the installation. A plurality of plastic blocks 10 are mounted therein. It is to be noted that the frame may be constructed off site with plastic blocks 10 mounted therein. Thereafter, the unit, as a whole, may be delivered to the site of the installation. Such off site construction has several advantages. These include installation of the plastic blocks within the frame by skilled artisans to ensure accurate fitting and sealing. The location of assembly may be in an environment conducive comfort of the assemblers to minimize frustration and anger and presumably resulting in a high quality of workmanship. By constructing the assemblies in an off site environment, mass production techniques can be employed to minimize labor costs. Others skilled in the trade will become aware of yet further advantages.

I claim:

1. A vented hollow plastic block for use in a wall section or panel, said plastic block comprising in combination;

a) a pair of members, each of said members including a continuous side wall, said side wall of one of said members including a lip and said side wall of the other of said members including a shelf for receiving and mating with said lip and forming a junction;

b) a sheet of material adapted for partly reflecting solar radiation, said sheet of material being located interior of and extending across said plastic block two compartments within said plastic block to define two compartments within said plastic block; and c) a vent extending through one of said side walls.

2. The vented hollow plastic block as set forth in claim 1 wherein said sheet of material includes a slot adapted to provide fluid communication between said two compartments.

3. The vented hollow plastic block as set forth in claim 2 wherein said slot is essentially coincident with said vent.

4. A vented hollow plastic block for use in a wall section or panel, said plastic block comprising in combination;

a) a pair of members, each of said members including a continuous side wall, said side wall of one of said members including a lip and said side wall of the other of said members including a shelf for receiving and mating with said lip and forming a junction;

b) a sheet of material adapted for partly reflecting solar radiation, said sheet of material being located interior of and extending across said plastic block and being disposed at said junction; and c) a vent extending through one of said side walls.

5. The vented hollow plastic block as set forth in claim 4 wherein the peripheral edge of said sheet of material is coincident with said shelf and retained thereagainst by said lip.

6. The vented hollow plastic block as set forth in claim 5 including an adhesive for securing said sheet of material in place.

7. The vented hollow plastic block as set forth in claim 4 including an adhesive for securing said sheet of material in place.

8. A vented hollow plastic block for use in a wall section, said plastic block comprising in combination;

a) a pair of members, each of said members including a continuous side wall and defining an edge, said edge of one of said members being mated with said edge of the other of said members to form a junction;

b) a vent disposed in at least one of said side walls, said vent having an area equivalent to a circle having a diameter in the range of about 0.005 inches to about 0.025 inches;

c) a sheet of material disposed within said plastic block and supported by said side wall of at least one member of said pair of members and adapted to define two compartments within said plastic block; and d) a further vent disposed in said sheet of material for providing fluid communication between said two compartments.

9. The vented hollow plastic block as set forth in claim 8 wherein said aperture has an area equivalent to a circle having a diameter in the range of about 0.012 inches to about 0.015 inches.

10. The vented hollow plastic block as set forth in claim 8 wherein said vent and said further vent are substantially coincident.

11. The vented hollow plastic block as set forth in claim 10 wherein said vent and said further vent are juxtaposed with one another.

12. The vented hollow plastic block as set forth in claim 8 wherein each of said members is of translucent plastic material.

13. The vented hollow plastic block as set forth in claim 8 wherein each of said members is of transparent plastic material.

14. The vented hollow plastic block as set forth in claim 8 wherein each of said members is square in planform and wherein said sheet of material is square in planform.

15. A vented hollow translucent/transparent plastic block of use in a wall section, said plastic block comprising in combination;

a) a pair of members, each of said members including a continuous side wall;

b) a sheet of material extending across the interior of said plastic block to define two compartments within said plastic block;

c) said side wall of one of said members being in sealed engagement with said side wall of the other of said members; and d) a vent disposed in one of said side walls and adapted to be in fluid communication with the interior of said plastic block.

16. The vented hollow translucent/transparent plastic block as set forth in claim 15 wherein said sealed engagement is adapted to support said sheet of material.

17. The vented hollow translucent/transparent plastic block as set forth in claim 16 wherein said vent is formed at the junction of said side walls including a further vent disposed in said sheet of material.

18. The vented hollow translucent/transparent plastic block as set forth in claim 17 wherein said further vent is substantially coincident with said vent.

19. A vented hollow plastic block for use in a wall section or panel, said plastic block comprising in combination;

a) a pair of members, each of said members including a substantially planar inner surface and a continuous side wall, said side wall of one of said members including a lip and said side wall of the other of said members including a shelf for receiving and mating with said lip and forming a junction;

b) a thin substantially planar sheet of material adapted for partly reflecting solar radiation, said sheet of material being located interior of and extending across said plastic block and spaced apart from said inner surfaces of each of said members; and c) a vent extending through one of said side walls.

20. A vented hollow translucent/transparent plastic block of use in a wall section, said plastic block comprising in combination;

a) a pair of members, each of said members including a substantially planar inner surface and a continuous side wall;

b) a substantially planar sheet of material extending across the interior of said plastic block and spaced apart from said inner surfaces of said members;

c) said side wall of one of said members being in sealed engagement with said side wall of the other of said members; and d) a vent disposed in one of said side walls and adapted to be in fluid communication with the interior of said plastic block.

* * * * *